United States Patent [19]

Paphitis

[11] 4,231,033

[45] Oct. 28, 1980

[54] LOGIC LEVEL SHIFTERS AND THEIR APPLICATION IN LUMINOUS DISPLAY CIRCUITS

[76] Inventor: Alexandre Paphitis, Rua Djalma Ulrich 57, Apt. 1006, Copacabana, 20.000 Rio de Janeiro ZC-37, Brazil

[21] Appl. No.: 940,812

[22] Filed: Sep. 11, 1978

[51] Int. Cl.[3] ..... G09G 3/14

[52] U.S. Cl. ..... 340/762; 340/756; 340/811

[58] Field of Search ..... 340/754, 762, 782, 811, 340/756, 761

[56] References Cited

U.S. PATENT DOCUMENTS

| | | | |
|---|---|---|---|
| 3,717,867 | 2/1973 | Rosenzweig | 340/761 |
| 3,969,672 | 7/1976 | Wallander et al. | 240/762 X |
| 4,009,566 | 3/1977 | Ho | 340/762 X |
| 4,017,847 | 4/1977 | Burford et al. | 340/762 X |
| 4,085,352 | 4/1978 | Hilton | 340/782 X |

*Primary Examiner*—David L. Trafton

*Attorney, Agent, or Firm*—Beveridge, DeGrandi, Kline & Lunsford

[57] ABSTRACT

Logic level shifting circuits are described in which integrated circuits process binary logic input signals of logic levels different from the input logic levels of said integrated circuits but within the ranges of tolerance and safety of said integrated circuits. Such logic level shifting techniques are used as a simple but effective method to cut down power consumption in luminous displays using seven-segment LED's or the like which may be placed in series as a result of logic level shifting between the respective counters and decoders which control them.

5 Claims, 5 Drawing Figures

LOGIC LEVEL SHIFTERS AND THEIR APPLICATION IN LUMINOUS DISPLAY CIRCUITS

BACKGROUND OF THE INVENTION

The present invention refers to new techniques for taking advantage of the properties of certain known types of integrated circuits to obtain level shifts in binary data signals. In particular, it is known that the majority of very low power logic families of integrated circuits—such as complementary metal oxide semiconductor (C.MOS) or complementary symmetry C.MOS (COS/MOS) have wide range tolerances of recognition of logic one and zero signals which might suffer variations during use, thus providing high noise immunity.

These tolerances are exemplified by the following discussion of C.MOS circuits. Most standard C.MOS circuits operated between power supply potentials of $V_{dd}$ and $V_{ss}$ which vary from $V_{dd}-V_{ss}=3$ volts to $V_{dd}-V_{ss}=15$ volts or even 18 volts (see "Focus on C.MOS" by Edward Torrero, Electronic Design C, Mar. 15, 1974) or 20 volts. The logic output levels are substantially $V_{dd}$ and $V_{ss}$, respectively, and any variations are so small as to be negligible. The logic input levels, however, may vary typically up to 30% and maximally up to 45% from the nominal values. Consequently logic input levels as low as $V_{dd}-0.3\ (V_{dd}-V_{ss})$ and as high as $V_{ss}+0.3\ (V_{dd}-V_{ss})$ are still recognized by a given integrated circuit as logic one and logic zero, respectively. When the logic input levels are between these two values, there is an intermediate region which should not be used. It should be emphasized that most known circuits work well with less noise immunity than the one mentioned.

For logic input levels, however, which exceed $V_{dd}$ or are less than $V_{ss}$, there is a range of K volts through which the circuit can still satisfactorily operate. As a result, the following conditions define the permissible logic levels:

$$V_{dd}+K \geqq \text{logic } 1 \geqq 0.7V_{dd}+0.3V_{ss} \quad (1)$$

$$0.7V_{ss}+0.3V_{dd} \geqq \text{logic } 0 \geqq V_{ss}-K \quad (2)$$

"K" is a constant given by the manufacturer and for the particular type of integrated circuit being used throughout this specification, K=15 volts which means that all the C.MOS integrated circuits of the particular family and manufacturer can handle +15 V input signals beyond the logic levels defined without risk of damage.

It should be emphasized that the above information and equations represent the characteristics of known integrated circuits, as supplied by the manufacturers to define their noise immunity and their flexibility in terms of power supply potentials but that, to applicant's knowledge, they have not been used in the manner that will be described in this specification.

The above information has been considered by applicant in particular, although not exclusive, relation to the power consumption problem of luminous display circuits. Although the types of integrated circuits used in modern luminous displays belong in the most part to the very low power logic families, they are used to drive multi-segment Light Emitting Diodes (LED's) or other relatively high power consumption indicators. Thus we have that a typical C.MOS integrated circuit has a negligible power consumption in the order of microwatts whereas, depending on the brightness required, the current requirements of a typical LED vary between 2 mA/segment and 20 mA/segment for a forward voltage of typically 1.7 volts. Consequently a LED display system consisting of only four parallel connected seven segment LED's would typically consume $(7\times10)\times4=280$ mA, or a maximum of 560 mA. It is, however, common to use up to ten or more LED's, for example in digital counter applications, resulting in much higher power consumption (up to 1.5 A). This higher consumption is so serious that very often, especially in portable instrument design, LED displays are not used. The use of LED's, however, results in higher precision readout and better visibility than any other known type of analog display or indicator or liquid crystal system that needs an external light source.

One way to limit the power consumption of single segment LED's (one anode, one cathode) is given by C. D. Patterson in "Driving LED's directly from C.MOS logic outputs" published in Electronics, page 116, July 25, 1974, in which a bipolar transistor between a C.MOS logic output and a LED indicator is used to control the latter. The bipolar transistors are connected in series so that the same current drives several LED's each of which is tied between the emitter and collector of the transistors.

SUMMARY OF THE INVENTION

It is an object of the invention to provide a circuit for manipulating binary logic signals which effects a logic level shift.

It is a further object of this invention to use such logic level shifting so that multiple segment luminous display devices may be effectively series connected through controlling integrated circuits.

According to a first aspect of the present invention, a logic level shifting circuit for processing binary coded data, comprises a first integrated circuit connected between first and second power supply potentials and having a binary output representing a logic one substantially at the level of said first potential and a logic zero substantially at said second potential, and a second integrated circuit connected between third and fourth potentials at least one of which is different from the corresponding first or second potential, said second integrated circuit being controlled by said first integrated circuit output, the level of said third potential with respect to that of said first potential being such that said second integrated circuit sees said first potential as a logic one and the level of said fourth potential with respect to said second potential being such that said second integrated circuit sees said second potential as a logic zero, whereby said second integrated circuit produces a binary output representing a logic one substantially at the level of said third potential and a logic zero substantially at the level of said fourth potential.

It will thus be seen that by applying equations (1) and (2) above it would be possible, for example, to have two of said first integrated circuits connected in parallel between the same first and second power supply potentials controlling two of said second integrated circuits connected in series so that said fourth potential of one is the third potential of the other. LED's could then be controlled by the outputs of said second integrated circuits and connected in series.

Accordingly, a second aspect of the invention refers to a multi-stage luminous display circuit in which each stage comprises a driver having binary outputs, a decoder connected to said driver outputs and having a plurality of outputs, and a luminous display device having the same said plurality of electrodes of a first relative polarity and at least one electrode of a second relative polarity, said plurality of electrodes being connected to said decoder outputs and said at least one electrode being connected to the power input terminal of the decoder of the next stage so that said display devices are effectively connected in series through said decoders, the power supply potentials of each said driver being so related to the power supply potentials of its associated same stage decoder that the logic one and logic zero signals produced on said driver outputs lie within the ranges of safety and tolerance of said same stage decoder to be recognized as logic one and zero.

In a preferred embodiment the driver is a binary coded decimal counter having four binary coded decimal outputs and the display device has seven of said first relative polarity electrodes.

The invention will now be described in greater detail, by way of example, with reference to the accompanying drawings, in which.

Figure 1:
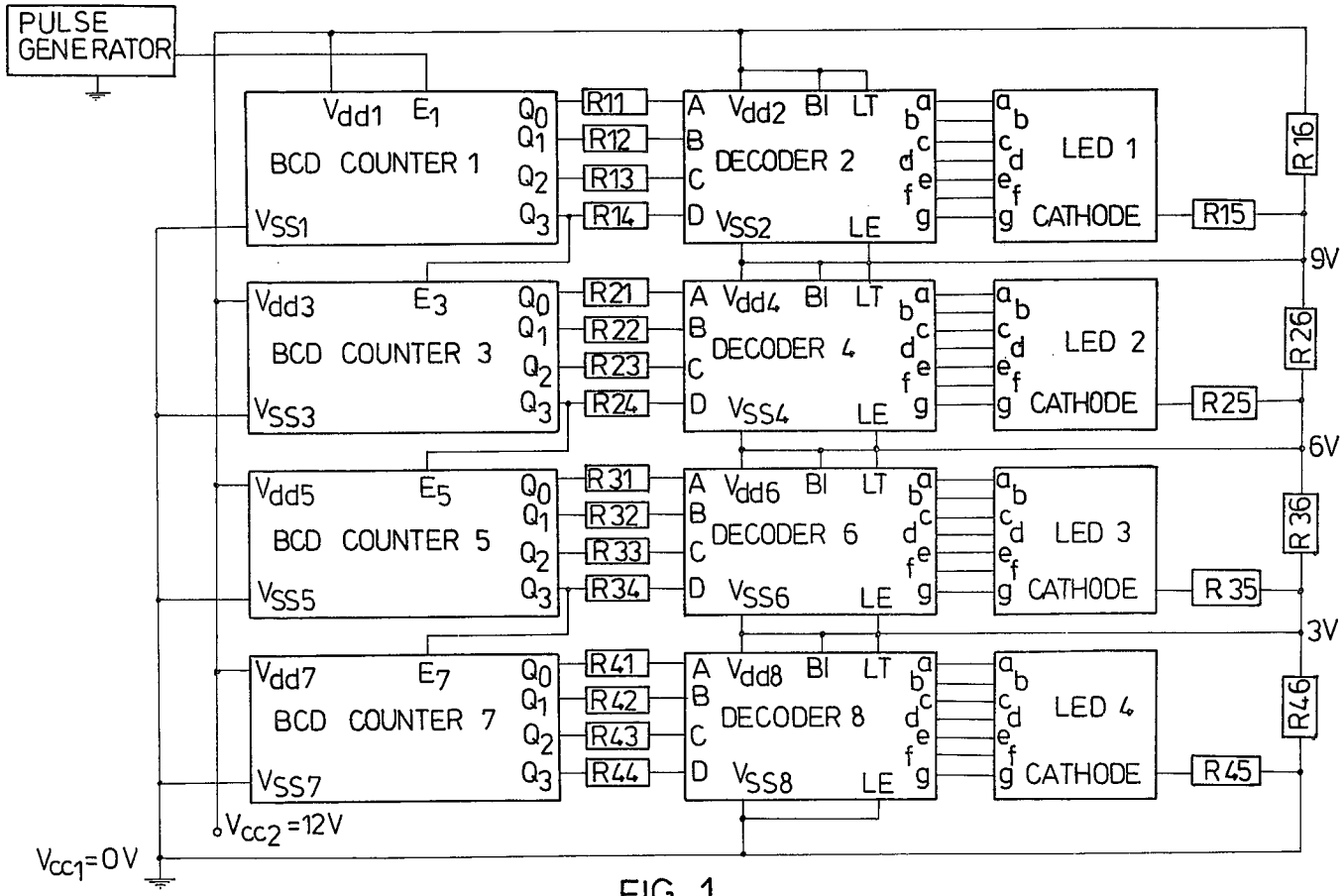
FIG. 1 shows a four stage counter and display system according to the present invention.

Referring now to FIG. 1 of the drawings, each stage comprises a counter 1, 3, 5 or 7, a BCD to seven segment decoder and driver 2, 4, 6 or 8 and a respective seven segment Light Emitting Diode LED 1, LED 2, LED 3 or LED 4. In all the embodiments described herein, each counter is one half of a "Dual BCD Decode Counter" type 4518 and the decoders are type 4511 as manufactured by Fairchild U.S.A. (or Motorola Inc. U.S.A. as types 14518 and 14511), respectively).

As the name indicates, the 4518 consists of two separate BCD counters, but with common power supply terminals. Each has an ENABLE input "E" acting at every transition from a high level to a low level and a CLOCK input (tied on $V_{ss}$ potential and hence not further considered).

The digital signals at the outputs $Q_o$ through $Q_3$ is Binary Coded Decimal. A RESET input to zero the counter is also available but as it is not however of specific interest in the present case it is not considered. The output $Q_3$ changes once for every ten pulses applied at the input E of the counter.

In the simple embodiment shown in FIG. 1, the BCD counters 1, 3, 5 and 7 are used as divide-by-ten stages. The LED's are of the type FND357 and have seven segments "a" through "g" (seven separated anodes) and a common cathode. Each decoder/driver 2, 4, 6 and 8 of the type 4511, used to convert the BCD code into a seven-segment decoded output to drive each LED has a high current drive capability which reaches up to 20 mA per output. Each decoder comprises four inputs A through D capable of receiving a BCD coded signal drive so as to provide the seven outputs "a" through "g" to the corresponding LED.

Further unused decoder inputs such as BI, LT and LE are not used in this example and are put to fixed potentials, as recommended by the manufacturer.

In FIG. 1 the various terminals are marked the same for corresponding devices of the different stages and are differentiated only when necessary by numerals following the identifying letter, i.e. a 1 for counter 1, a 2 for decoder 2 and so on. The power supply potentials are thus $V_{dd1}$, $V_{ss1}$, $V_{dd2}$, $V_{ss2}$, etc. The outputs and inputs of the devices in the drawings are not differentiated because there is no danger of confusing them. The resistors R11-R14, R21-R24, R31-R34 and R41-R44 between counters and decoders are current limiters between integrated circuits of different power supplies. Resistors R15, R25, R35 and R45 are used to limit LED current and control brightness of the display. Resistors R16, R26, R36 and R46 form a voltage divider and supply decoders 2 through 8, with different level but equal power supply voltages, that is to say, 12 V to 9 V for decoder 2, 9 V to 6 V for decoder 4 and so on.

A pulse generator feeds BCD counter 1 with pulses between $V_{cc1}=0$ volts ($V_{ss}$ of all the counters) and $V_{cc2}=12$ volts ($V_{dd}$ of the counters).

The $Q_3$ output of counter 1 is applied as a carry out to the $E_3$ input of counter 3 and so on up to counter 7, giving a divide ratio of 10,000:1 for the four counter stages.

The corresponding decoders 2, 4, 6 and 8 receive the BCD code from the counters whereby the counting state of each counter is indicated by using the LED's 1 through 4 put in series through the resistors $R_{16}$, $R_{26}$, $R_{36}$ and $R_{46}$.

Considering now decoder 2, the logic one signals received at inputs A, B, C and D from counter 1 have a voltage level equal to $V_{dd1}=V_{dd2}=V_{cc2}=12$ volts and this is obviously seen by the decoder as logic one. The logic zero signals appearing at the inputs A, B, C and D of decoder 2 are equal to $V_{ss1}=V_{cc1}=0$ volts. $V_{ss2}$ (of decoder 2) is however 9 volts. The decoder sees such signal as a logic 0, since it obeys the right hand side of condition (2) above, that is to say:

$$V_{ss1} = 0 \text{ volts} = \text{logic } 0 \geqq V_{ss2} - K \geqq 9-15 \geqq -6 \text{ volts.}$$

In the case of decoders 4, 6 and 8, the logic one signals at the input are also always equal to 12 volts which obeys the left hand side of condition (1) above, that is to say:

$$V_{dd4}+K=9+15=24 \geqq \text{logic } 1=12 \text{ volts (decoder 4)}$$

$$V_{dd6}+K=6+15=21 \geqq \text{logic } 1=12 \text{ volts (decoder 6)}$$

$$V_{dd8}+K=3+15=18 \geqq \text{logic } 1=12 \text{ volts (decoder 8).}$$

As far as the logic inputs are concerned it is clear that there will be no more problem with decoder 8 for which $V_{ss8}$ is equal to $V_{ss7}$. Decoders 4 and 6, however, satisfy the right hand side of condition (2) as follows:

| | |
|---|---|
| $V_{ss1}$ = 0 volts = logic 0 | $V_{ss4} - k = 6-15 = -9$ volts |
| $V_{ss1}$ = 0 volts = logic 0 | $V_{ss6} - k = 3-15 = -12$ volts |

It will therefore be seen that the display circuit of FIG. 1 satisfactorily uses four LED's connected in series through the decoders, between power supply potentials $V_{cc2}$ and $V_{cc1}$. This is made possible because the power supply potentials of the series connected decoders compared to those ($V_{cc2}$ and $V_{cc1}$) of the counters result in logic level shifts between the logic zeros of the counters and those of decoders 2, 4 and 6 and between the logic ones of the counters and those of decoders 4, 6 and 8.

In the FIG. 1 type of arrangement, however, the maximum power supply range of 18 volts that can be used across the parallel counters, limits the system to a maximum of six LED's in series. The arrangement then has a consumption of one-sixth of the normal (i.e. six LED's in parallel). It is sometimes of interest, especially for non-portable instrument design, to reduce cost by time sharing a common decoder. These cases and the various aspects involved are analyzed in "Matching Driver Circuitry to Multidigit numeric displays" by Alan Sobel, published in Electronics, Apr. 25, 1973, p.p. 95-99.

The present invention is being discussed, moreover, merely with regard to the logic level shifting and the consequent possibility of economising power consumption. This does not exclude other possibility such as pulsed control of the LED's through decoder inputs BI. In such a case, additional power reduction is obtained by turning the LED's on and off in the rhythm of the pulses applied at the BI input. It will also be noted that the greater the number of LED's in series and the higher the per unit consumption, the higher will be the relative power reduction.

Figure 2:
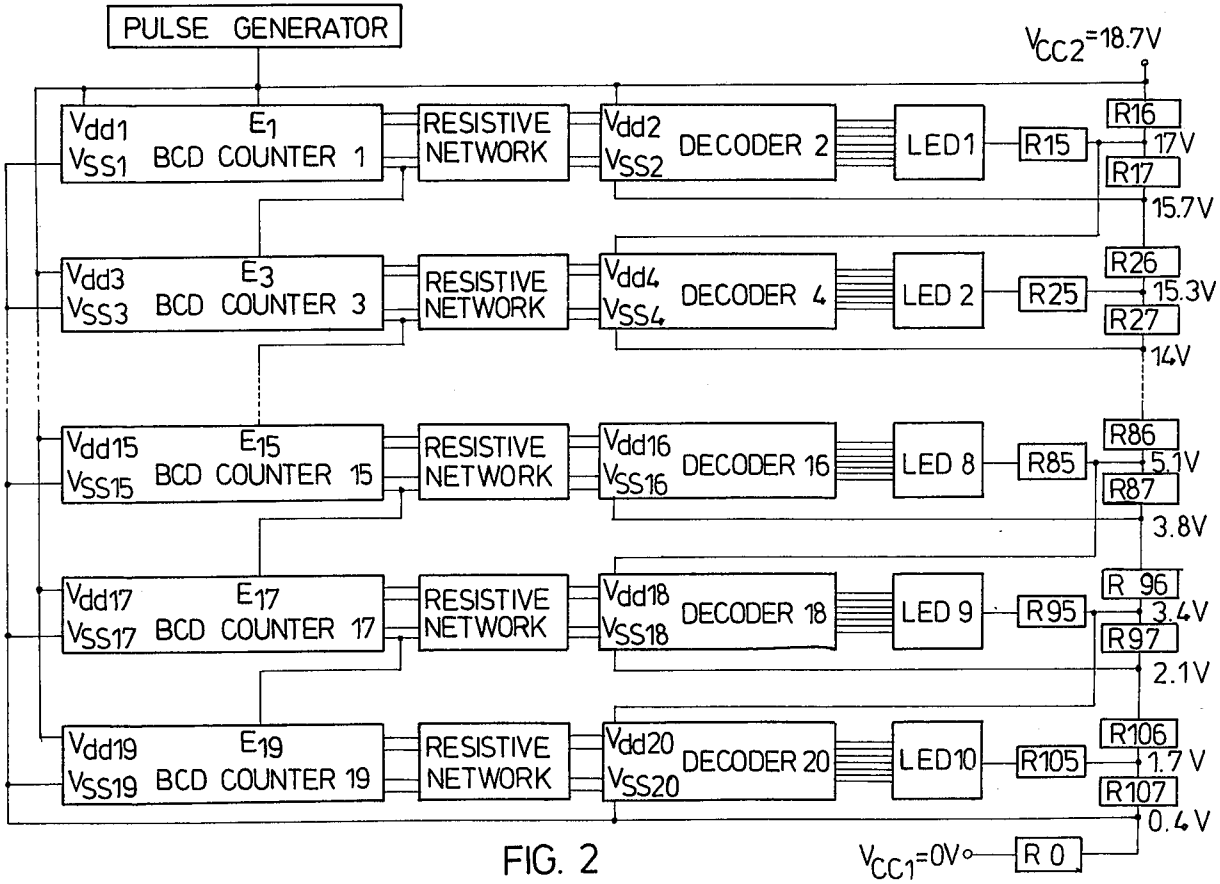
FIG. 2 shows a ten stage counter and display system according to the present invention.

FIG. 2 shows a ten LED configuration in accordance with the present invention. The only difference here, when compared with FIG. 1, is that the difference between the $V_{dd}$'s of adjacent decoders is chosen as 1.7 V and not 3 volts. The resistors $R_{11}$, $R_{12}$ etc. of FIG. 1 are indicated in FIG. 2 merely as "Resistive Network".

The input levels, in FIG. 2, to decoders 2, 4, 6----18,20 vary between 0.4 V and 18.7 V. Power supplies up to 20 V are allowable for Mc MOS (MOTOROLA series) whereas the outputs are quite different. For example, decoder 2 output levels vary between 15.7 V and 18.7 V, decoder 4 output levels vary between 14 V and 17 V and so on. This "Logic Level Shifting" uses two logic levels (0.4 V and 18.7 V) to produce a plurality of logic levels at the outputs of several decoders put in series. This makes it possible to put up to 10 LED's in series. It is obviously preferred, however, to put an unlimited number of LED's (or other similar devices of high power consumption) in series, reducing the total consumption to the consumption of one LED or other similar device.

Figure 3A:
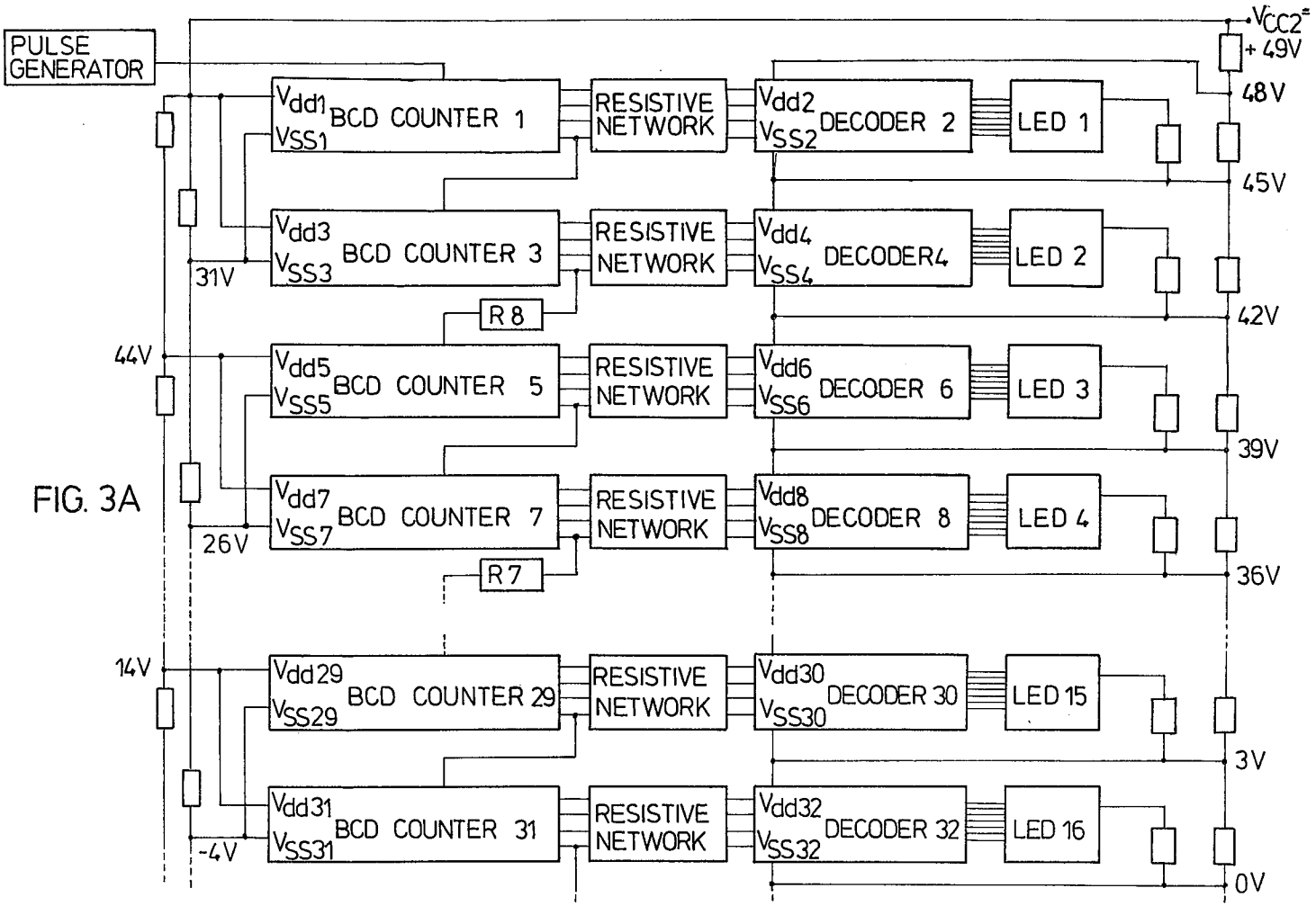
FIGS. 3A, 3B and 3C together show a thirty two stage display system according to the invention.
Figure 3B:
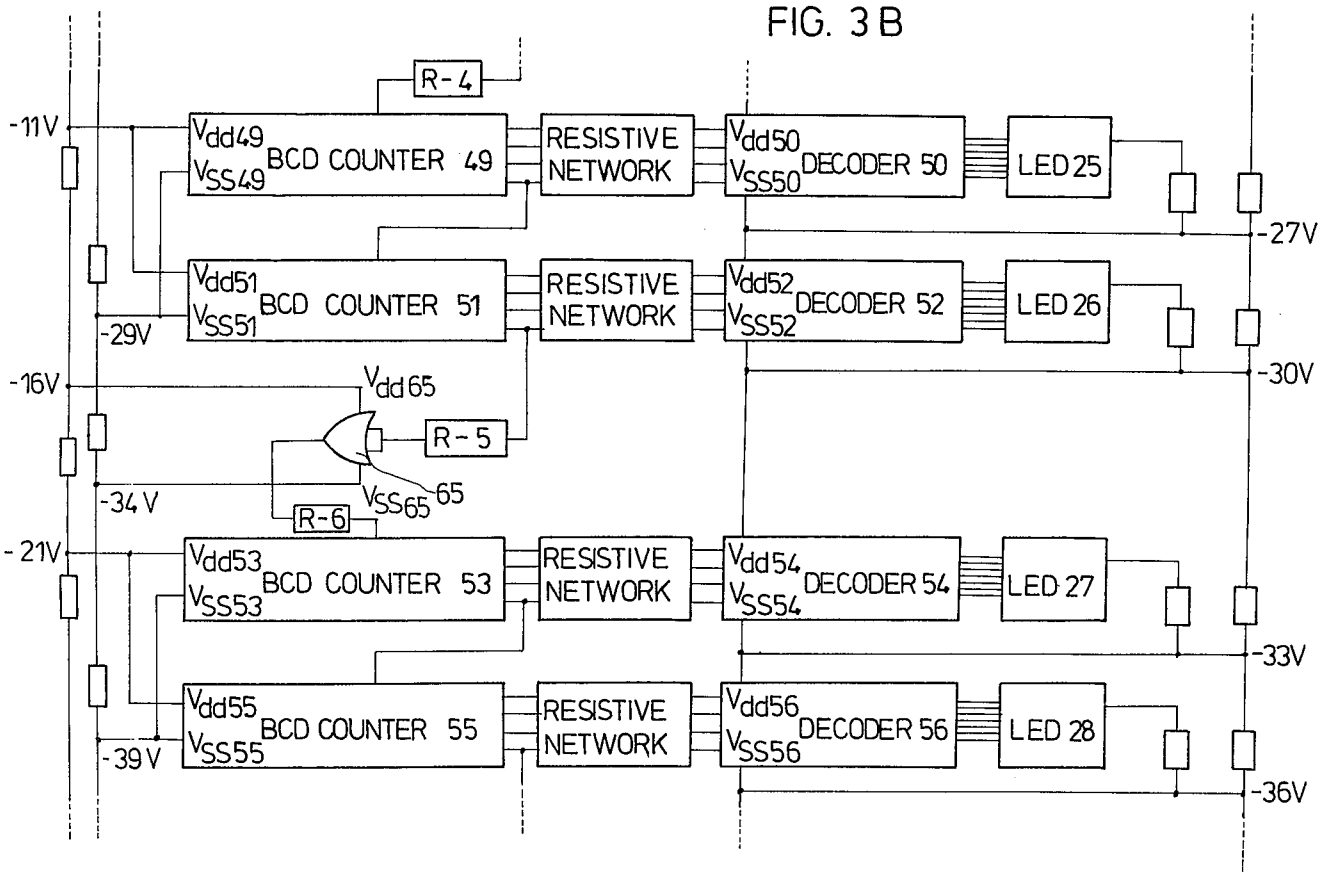
Figure 3C:
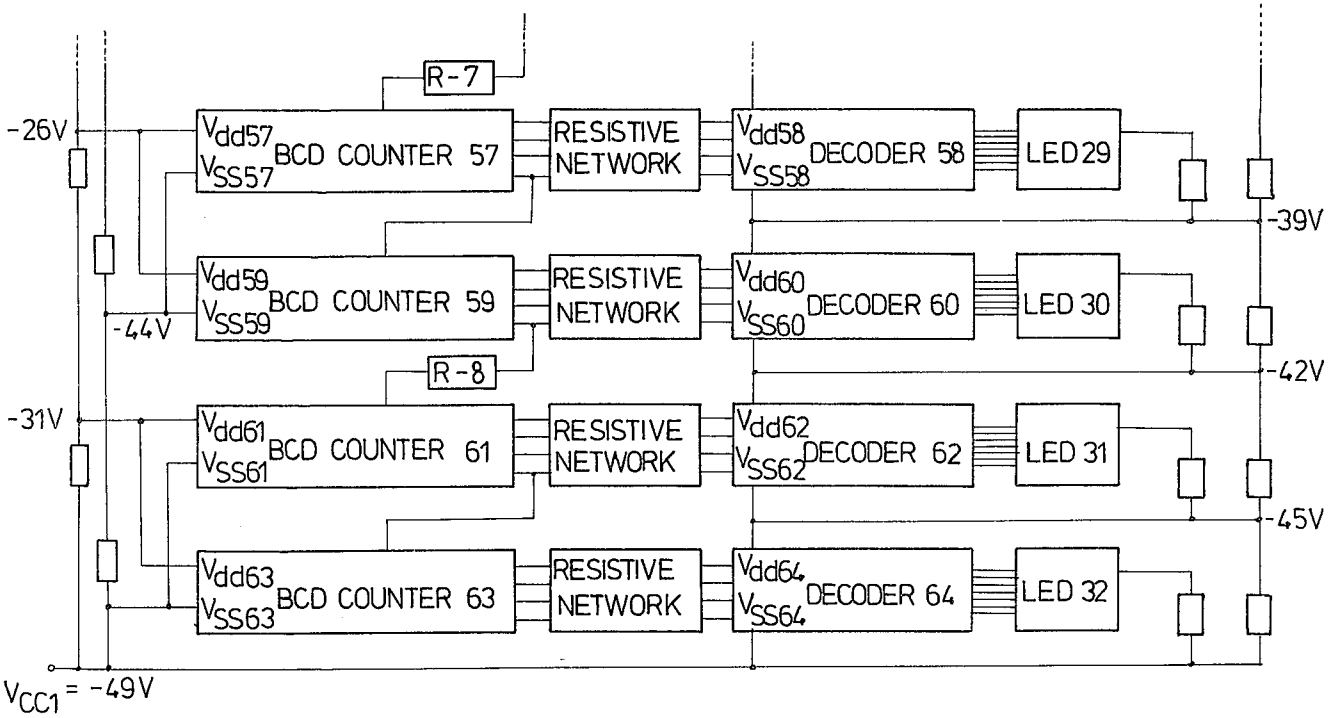

Such a preferred implementation is shown in FIGS. 3A, 3B and 3C which represent a thirty two stage counter having counters 1,3,5----61,63, decoders 2, 4, 6----62,64 and Light Emitting Diodes LED 1, LED 2, LED 3-----LED 31, LED 32, the latter being connected in series through the decoders exactly as in FIG. 1. In this preferred case, however, there are logic level shifts not only between the counters and the decoders but also between the counters of adjacent chips (two counter chips of the type 4518, as mentioned above).

It will therefore be seen in FIGS. 3A, 3B and 3C that between $V_{cc1}=-49$ volts and $V_{cc2}=+49$ volts, there are three voltage dividers. One, as in FIG. 1, provides the power supply potentials at 3 volt differences for the decoders, that is $V_{dd2}=48$ V, $V_{dd4}(V_{ss2})=45$ V-----$V_{dd64}(V_{ss62})=-45$ V. $V_{ss64}$ is 4 volts lower than $V_{dd64}$ but this is perfectly permissible with the type of decoder being used.

The second voltage divider establishes the $V_{dd}$ levels for the counters and the third voltage divider establishes the $V_{ss}$ levels therefor. The $V_{dd}$ levels, as far as the chip containing counters 53 and 55, are lower by 5 volts between each chip whereas the $V_{ss}$ levels are always 18 volts lower than the corresponding $V_{dd}$ levels. Thus we have $V_{dd1,3}=49$ V, $V_{ss1,3}=31$ V, $V_{dd5,7}=44$ V, $V_{ss5,7}=26$ V-----$V_{dd49,51}=-11$ V and $V_{ss49,51}=-29$ V. It will be seen from the left hand side of condition (2) that a logic zero on the carry over between chips must be less than or equal to $0.7V_{ss}+0.3V_{dd}$ of the counters receiving the signal, or $V_{ss}+0.3(V_{dd}-V_{ss})$. Since $V_{dd}-V_{ss}$ is always 18 volts, it will be understood that the $V_{ss}$ of one chip should never be more than 5.4 volts higher than the $V_{ss}$ of the next chip. For this reason the differences of 5 volts were chosen.

Resistors $R_8$ through $R_{-8}$ are current limiters between integrated circuits of different power supply potentials.

By applying the same logic conditions (1) and (2) between the counters and decoders, it will be seen that the decoders could be successfully driven down to counter (53) of the twenty seventh stage chip where a logic one counter output of −16 volts could be compatible with a decoder $V_{dd54}$ of −30 volts (a 15 volt difference is allowable). The second counter 55 of the same chip however would then give a logic one seventeen volts above decoder 56 $V_{dd56}=-33$ V which would not be compatible. This is a result of a cumulative one volt differences between the power supply levels of pairs of counters ($V_{dd1}-V_{dd5}=5$ V) and pairs of decoders ($V_{dd2}-V_{dd6}=6$ V). This problem is solved by inserting between the chips containing counters 51 and 53, respectively, a simple logic level shift circuit which will lower the logic levels of the subsequent counter outputs to make them compatible with their decoders.

This logic level shift circuit comprises an OR gate 65 housing its two inputs connected in common to the Q3 terminal of counter 51 and its output tied to the Enable input of counter 53. The $V_{dd}$ terminal of OR gate 65 is connected to the −16 V tap on the $V_{dd}$ voltage divider and its $V_{ss}$ terminal is tied to the −34 volt tap of the $V_{ss}$ voltage divider. In this way the logic signal at the Q3 output of counter 51 is recognized by counter 53 although the latter has a $V_{dd53}$ of −21 volts and a $V_{ss}$ of −39 volts. The remaining two counter chips, with counters 57,59 and 61,63, are then once more connected to $V_{dd}$'s which vary by 5 volts with 18 volts between their power supply terminals, as described above.

The full significance of the present invention can be seen from the FIGS. 3A, 3B and 3C implementation which is illustrative of how an indefinite number of LED's can be put in series by employing the logic level shifting possibilities of known integrated circuits in three different ways, that is to say:

(a) by simple variation of the power supply levels between the counters and the decoders, provided conditions (1) and (2) are met;

(b) by simple variations of the power supply levels of the counters in accordance with the conditions (1) and (2); and (c) by the use of separate level shift circuits between adjacent counters (or between a counter and a decoder) to permit conditions (1) and (2) to be met in (a) and (b) above.

Finally, attention is directed to the possibilities of FIG. 3 when used with the FIG. 2 arrangement in which the $V_{dd}$'s of adjacent decoders have a difference equal to the voltage drop across the LED's, 1.7 volts in the example, as opposed to the 3 volt difference $V_{dd}-V_{ss}$ of their own drive circuits permitting a greater number of LED's in series for a given power supply voltage $V_{cc2}-V_{cc1}$. In addition, the power supply of the decoders may be even greater than 3 volts, this being of special interest when a voltage drop occurs between a decoder and a LED. For instance, if such a voltage drop is of the order of 0.8 V, then $V_{dd2}$ should be tied to 19.5 V instead of 18.7 V, $V_{dd4}$ to 17.8 V and so on, this being easily effected with a slightly higher power supply voltage and modifying the values of the resistors between $V_{cc1}$ and $V_{cc2}$.

It will be understood by those versed in the art that the present invention has been described with reference to the accompanying drawings only by way of example and that the logic level shifting and reduction in power consumption techniques illustrated therein may be modified in many ways without departing from the true spirit and scope of the invention which is limited only by the terms of the following claims.

I claim:

1. A multi-stage luminous display circuit, each stage comprising a driver having binary outputs, a decoder connected to said driver outputs and having a plurality of outputs, and a luminous display device having the same said plurality of electrodes of a first relative polarity and at least one electrode of a second relative polarity, said plurality of electrodes being connected to said decoder outputs and said at least one electrode being connected to the power input terminal of the decoder of an adjacent stage so that said display devices are effectively connected in series through said decoders, the power supply potentials of each said driver being so related to the power supply potentials of its associated same stage decoder that the logic one and logic zero signals produced on said driver outputs lie within the ranges of safety and tolerance of said same stage decoder to be recognized as logic ones and zeros.

2. A multi-stage luminous display circuit according to claim 1 in which each said luminous display is a multi-segment light emitting diode.

3. A multi-stage luminous display circuit according to claim 2 comprising a pair of power supply input terminals for connection to first and second potentials and a voltage divider connected between said terminals and having taps connected to said counters and decoders for applying appropriate power supply potentials thereto, the counter of the first stage having an external binary pulse input and each subsequent stage counter having its input connected to at least one of the outputs of the previous stage counter, the power supply potentials of the counters being chosen so that at least the majority of said counters recognizes the drive potentials of the respective previous counters as logic ones and zeros respectively, any pair of counters in which the power supply potentials of one are not both directly recognized as logic one and zero respectively by the subsequent one being provided with an integrated circuit in the connection between the output of said one counter and the input of said other counter, said integrated circuit having power supply potentials such that it recognizes the power supply potentials of said one counter as logic one and zero and said other counter recognizes the power supply potentials of said integrated circuit as logic one and zero respectively within the ranges of safety and tolerance of said integrated circuit and said other counter respectively.

4. A multi-stage luminous display circuit according to claim 1 in which each said driver comprises a binary coded decimal counter having binary coded decimal outputs and each said decoder has seven decoded outputs, said display device having seven electrodes of said first relative polarity.

5. A multi-stage luminous display circuit according to claim 1 in which said fourth potential of each decoder is lower than the third potential of the immediately subsequent stage decoder.

* * * * *